US005121590A

United States Patent [19]

Scanlan

[11] Patent Number: 5,121,590

[45] Date of Patent: Jun. 16, 1992

[54] VACUUM PACKING APPARATUS

[76] Inventor: Gregory P. Scanlan, 1311 Leafwood Dr., Novato, Calif. 94947

[21] Appl. No.: 532,887

[22] Filed: Jun. 4, 1990

[51] Int. Cl.[5] ..... B65B 31/04; B65B 7/28

[52] U.S. Cl. ..... 53/510; 53/88; 53/103; 53/390; 137/533.21; 141/65; 220/202; 220/366

[58] Field of Search ..... 53/79, 88, 101, 102, 53/103, 106, 107, 510, 390; 141/63, 64, 65; 137/533.21; 220/202, 366; 251/341, 335.1, 12

[56] References Cited

U.S. PATENT DOCUMENTS

| | | | |
|---|---|---|---|
| 665,020 | 1/1901 | Lees | 220/231 |
| 793,107 | 6/1905 | Staunton | 215/262 |
| 873,627 | 12/1907 | Staunton | 137/533.21 X |
| 892,886 | 7/1908 | Prest | 215/315 |
| 1,588,080 | 6/1926 | Winters | 53/103 |
| 1,638,383 | 8/1927 | Winters | 53/103 X |
| 2,214,346 | 9/1940 | Pim | 220/231 |
| 2,576,322 | 11/1951 | Waters | 53/88 X |
| 2,636,657 | 4/1953 | Lauritzen | 53/88 |
| 3,135,411 | 6/1964 | Osborne | 141/65 X |
| 3,672,114 | 6/1972 | Sacks | 53/88 |
| 3,943,987 | 3/1976 | Rossi | 150/0.5 |
| 4,051,971 | 10/1977 | Saleri et al. | 215/262 |
| 4,142,645 | 3/1979 | Walton | 215/262 |
| 4,249,583 | 2/1981 | Lundbladh | 141/65 |
| 4,278,114 | 7/1981 | Ruberg | 53/103 X |
| 4,909,014 | 3/1990 | Kobayashi et al. | 53/103 X |

FOREIGN PATENT DOCUMENTS

| | | | |
|---|---|---|---|
| 81299 | 9/1918 | Fed. Rep. of Germany | 53/103 |
| 97029 | 5/1921 | Fed. Rep. of Germany | 53/103 |
| 102264 | 2/1923 | Fed. Rep. of Germany | 53/103 |
| 200360 | 10/1938 | Fed. Rep. of Germany | 141/65 |
| 166478 | 1/1950 | Fed. Rep. of Germany | 53/103 |

*Primary Examiner*—Horace M. Culver
*Attorney, Agent, or Firm*—Harris Zimmerman

[57] ABSTRACT

Apparatus for evacuating and sealing containers of perishable food or other substances includes a rigid lid for fitting onto the container and a resilientt valve which is situated over a small passage in the lid. The valve has a hollow interior region which is open at the underside of the member and a stem extends down through the passage in the lid and carries an enlargement at its lower end that is broader than the passage. A hollow cup, coupled to a vacumm pump, is temporarily placed over the valve to draw air from the container after which atmospheric pressure urges the lid against the container and urges the valve against the lid to seal the container. The hollow interior of the valve is broader than the passage in the lid and thus atmospheric pressure is effective against an area of the valve that exceeds the area of the passage thereby assuring a very strong and reliable sealing effect. The construction is simple, economical and compatible with a variety of containers including pre-existing containers that may be found in the home and in restaurants. The lid may be proportioned and adapted for simultaneously evacuating and sealing a plurality of containers such as at restaurant salad bars.

7 Claims, 5 Drawing Sheets

VACUUM PACKING APPARATUS

TECHNICAL FIELD

This invention relates to the preservation of perishable foods or other substances in evacuated containers and more particularly to apparatus for evacuating and sealing containers.

BACKGROUND OF THE INVENTION

It is well recognized that deterioration of perishable foods can be inhibited if the foods are stored in containers from which air has been evacuated. Preservation of many substances other than foods can also be enhanced by vacuum packing. Photographic film negatives and silver objects are typical examples.

Vacuum packing of foods in processing plants is usually accomplished with complex and expensive machinery that is not practical for use in smaller scale operations. In restaurants and in the home, for example, relatively small quantities of foods are stored for consumption at a later date. The foods can be maintained in a fresher condition and the storage period can be prolonged by using evacuated containers including in instances where the stored foods are refrigerated.

A variety of container sealing devices have heretofore been developed for the purpose of enabling sealing and evacuation of containers. These have not proven to be entirely satisfactory for several reasons. Such devices typically include a container lid having an air passage and some form of valve for enabling withdrawal of air through the passage and subsequent closure and sealing of the passage. Some of these prior systems require an undesirably complicated and costly valve mechanism. Some are usable only with a particular form of specialized container. Others may be difficult to re-open when the contents of the container are to be recovered.

The more economical prior devices of this kind have a closure member at the air passage of the container lid that is typically of one of three kinds which are a plug that fits into the passage, a spherical ball check valve element or a flat piece of material that overlays the passage and a portion of the adjacent area of the lid. An inverted cup, coupled to a vacuum pump, is temporarily placed over the passage and the closure lifts to enable an outflow of air through the passage. When the vacuum source is deactivated, external air pressure acts against the closure member in a manner which seals the passage.

Each of the above discussed forms of closure member is subject to problems. Both plugs and spherical ball closures require that the passage in which they seat be formed very precisely or leakage will occur. Thin flat members that overlay the passage are subject to the same problem since it is only the portion of the member that is immediately over the passage that experiences a net downward force from ambient air pressure after the container is evacuated. Consequently, the peripheral portions of such a member that are not directly over the passage tend to be flexed upwardly and are out of contact with the surface of the lid. These upwardly flexed portions limit the zone of sealing contact to the edge of the passage and are also susceptible to being snagged and dislodged by movements in the vicinity of the container lid. In general, each of these three forms of passage closure have been less reliable than would be desirable and leakage has been a common problem.

The present invention is directed to overcoming one or more of the problems discussed above.

SUMMARY OF THE INVENTION

In one aspect, the present invention provides apparatus for enabling evacuation and sealing of a container by a vacuum pump having a cup-like air intake, the container being of a type which has a rigid rim defining a container opening. The apparatus includes a lid adapted for sealing engagement on the container rim over the container opening and which has an air passage that extends from the outer surface of the lid to the interior of the container when the lid is on the container. A hollow valve is disposed on the outer surface of the lid over the air passage and is proportioned to fit within the air intake of the vacuum pump. The lower portion of the valve is a resilient skirt which extends round a hollow interior chamber within the valve. The chamber is open at the underside of the valve and is broader than than the air passage of the lid. Thus upon removal of the vacuum pump intake, external air pressure exerts a sealing force on an area of the valve that is larger than the area of the air passage thereby providing a strong and reliable seal. Further means are provided for inhibiting removal of the valve from the lid.

In another aspect of the invention, the means for inhibiting removal of the valve from the lid includes a stem which extends down from the body of the valve through the air passage in the lid to a location which is within the container when the lid is engaged on the container. The lower end of the stem carries an enlargement that is broader than the air passage.

In another aspect, the invention provides a system for vacuum sealing a container which includes a vacuum source, a vacuum hose extending from the source and a hollow cup on the end of the hose. A rigid lid having a small air passage is fitted onto the container rim over a resilient seal. A hollow valve formed of resilient material and proportioned to be received within the hollow cup of the vacuum source is disposed over the air passage of the lid. The valve has a hollow interior region that is open at the underside of the valve and which is of greater breadth than the air passage. A stem extends down from the valve through the air passage and carries an enlargement at the lower end that is broader than the air passage and which is downwardly spaced from the lid when the valve is against the upper surface of the lid.

In still another aspect of the invention, a valve for attachment to the lid of a container over an air passage in the lid has a body which is broader than the air passage and the lower portion of the valve body is a resilient skirt that extends around a hollow interior chamber within the valve. The chamber is also broader than the air passage and is open at the underside of the valve. A stem extends down from the valve body through the chamber to a location spaced below the skirt and carries an enlargement at that location that is also broader than the air passage.

The invention enables vacuum packing of foods or other materials with a minimum of effort, costs and complications and in a highly reliable manner Components of the system can be reused and are compatible with both new and pre-existing containers of diverse different types. The valve in the preferred form of the invention does not seat in the passage through which air is exhausted from the container nor on the edge of that passage. The configuration of the valve member creates a continuous sealing zone that is on the surface of the container lid and spaced apart from the passage through which air is exhausted from the container. Consequently the passage need not be precisely formed and sealing is not adversely affected by irregularities in the shape of the passage or by bits of food or debris that may be present in the passage. The valve configuration extends the vacuum region out of the container itself to a location over the lid that is of greater diameter than the air passage in the lid. Consequently, external air pressure exerts sealing force against an area of the valve that is greater than the area of the air passage itself. This produces a very strong sealing force and reliably prevents leakage of air into the container. The enhanced sealing force does not make it more difficult to break the seal as this can be accomplished by squeezing the resilient valve to deform it prior to lifting the valve away from the container lid.

The invention, together with further aspects and advantages thereof, may be further understood by reference to the following description of the preferred embodiments and by reference to the accompanying drawings.

DETAILED DESCRIPTION OF THE PREFERRED EMBODIMENTS

Figure 1:
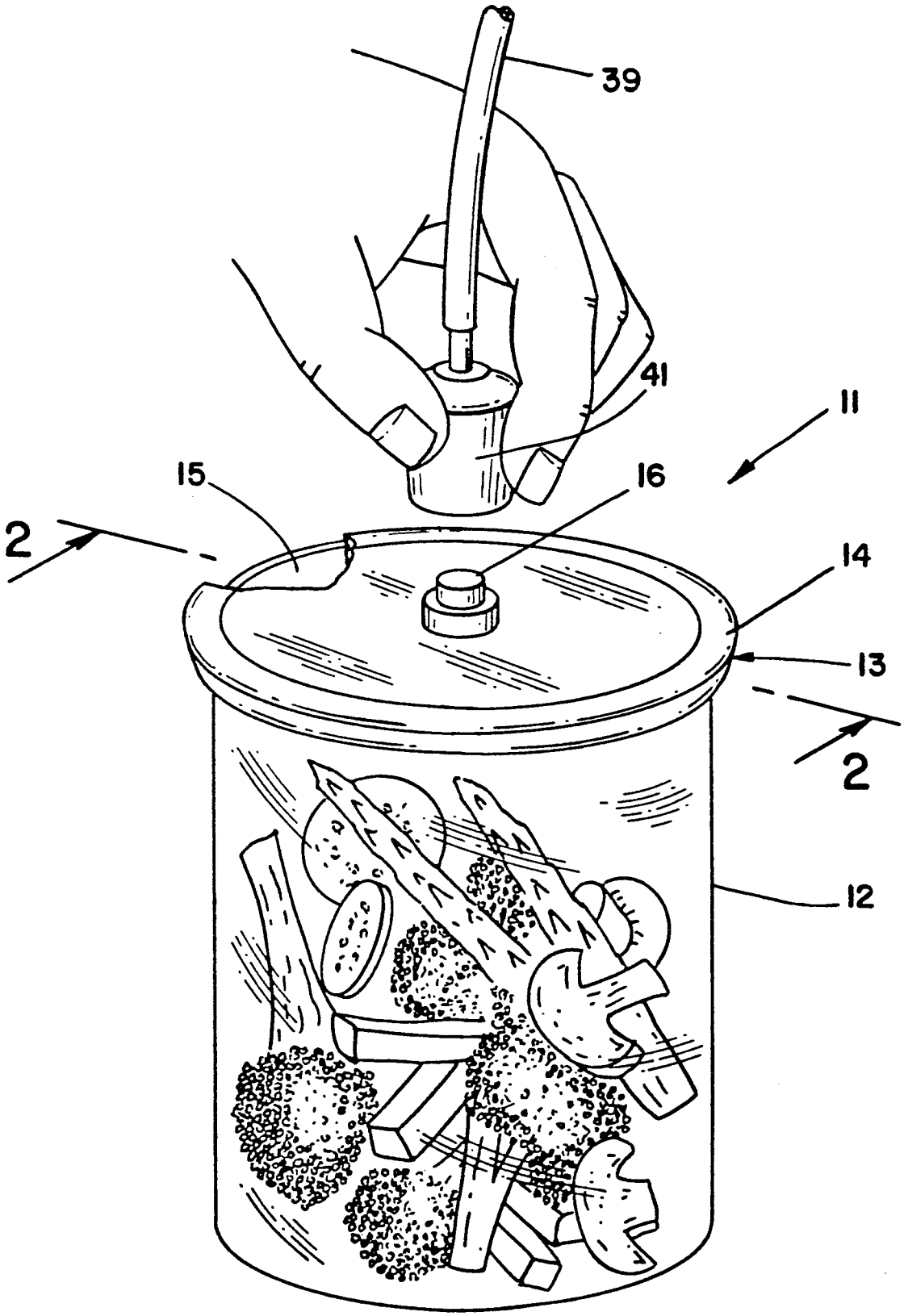
FIG. 1 is a perspective view of certain components of a system for evacuating and sealing a container in accordance with a preferred embodiment of the invention.

Referring to FIG. 1 of the drawings, a system 11 in accordance with the invention can be adapted for evacuating and sealing containers 12 of any of a wide variety of types provided that at least the rim 13 which defines the container opening 15 is formed of rigid material. The container 12 of this particular example is cylindrical and formed of rigid plastic but the system 11 is also adaptable to containers having other shapes and which are formed of other materials.

The container 12 need not necessarily have any specialized characteristics in order to be compatible with the evacuating and sealing system 11. Thus the system 11 may be used with pre-existing containers that are found in restaurants, homes, food processing centers and the like.

Components of the system 11 include a lid 14 adapted for fitting onto the container rim 13 and a valve member 16 loosely attached to the lid as will hereinafter be described in more detail. Lid 14 may be of the type that fastens to the container 12 by threads or other means but this is not necessary in all cases since external air pressure acts to clamp the lid on the container once it has been evacuated.

Figure 2:
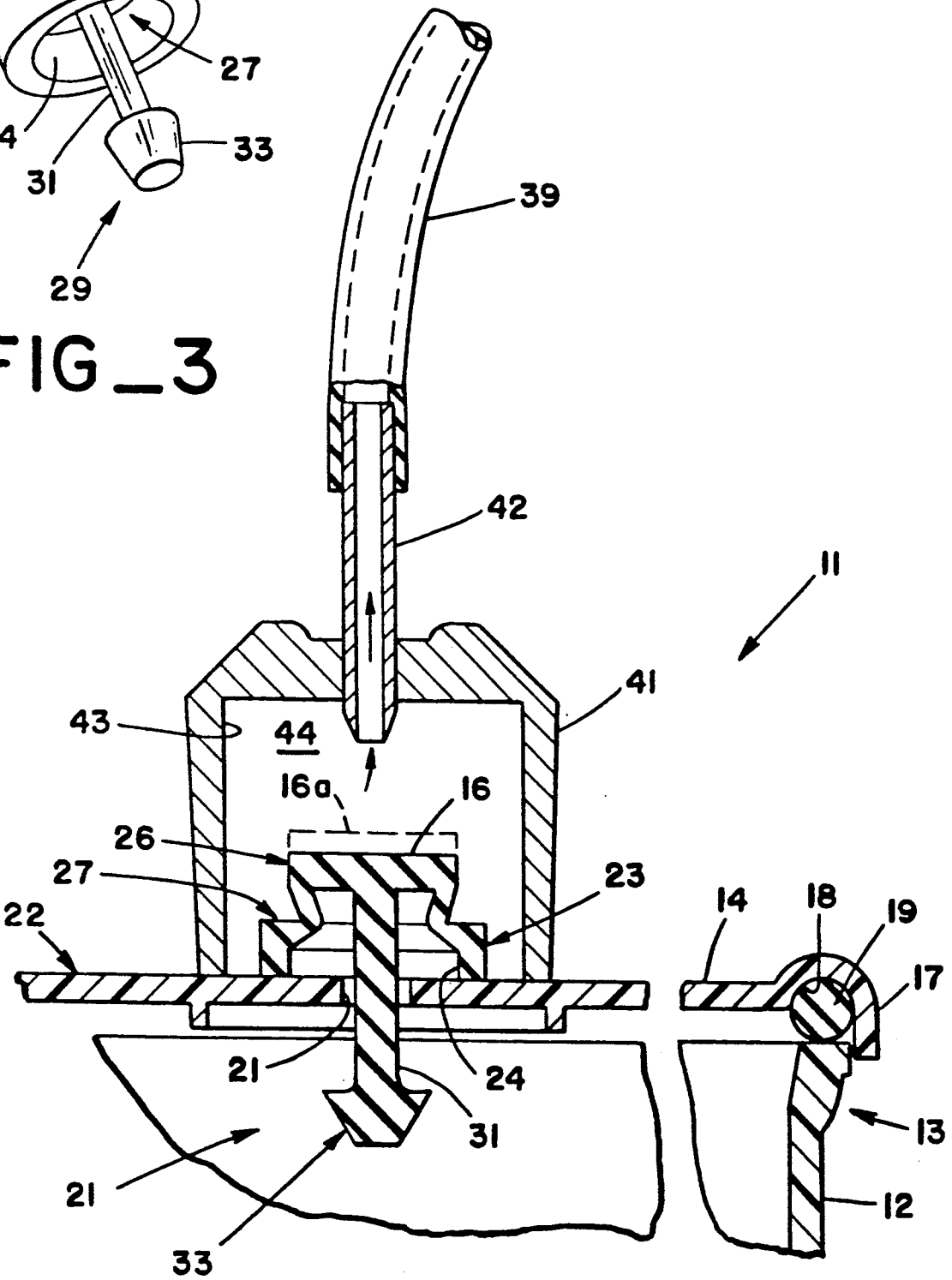
FIG. 2 is a foreshortened elevation section view of a portion of the apparatus of FIG. 1 taken along line 2—2 thereof.

Referring to FIG. 2, the lid 14 of this example is a flat circular disk formed of rigid material and having a downwardly directed peripheral edge 17 proportioned to extend a short distance below the top of container rim 13 when the lid is emplaced on container 12. Edge 17 is curved to form an annular seat 18 for a resilient seal 19 which is compressed against rim 13 when the lid 14 is drawn down by external air pressure, the seal being a rubber O-ring in this example although other forms of seal may also be used.

Lid 14 is transpierced by a small passage or hole 21 through which air is evacuated from container 12, the passage being centrally located on the lid in this example although it may also be situated elsewhere. As the passage 21 does not serve as a valve seat, it need not be cast or machined or ground to a precise form. Thus, pre-existing container lids can easily be adapted for use as a component of the present system simply by drilling or punching a hole through the lid.

Figure 3:
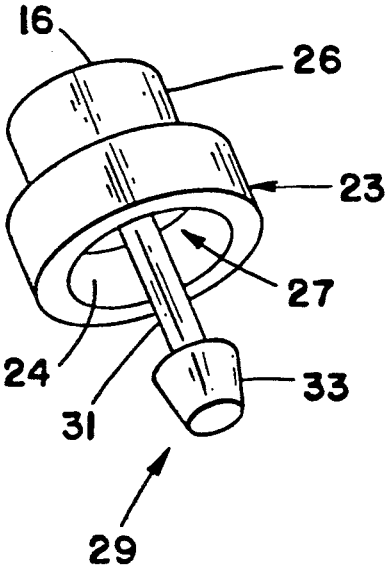
FIG. 3 is a perspective view of a valve component of the preceding figures.

Referring jointly to FIGS. 2 and 3, valve 16 is situated on the outer surface 22 of lid 14 over the air passage 21. At least the lower portion 23 of valve member 16 is formed of resilient material, the entire member being a unitary hollow body of rubber in this example. The lower portion 23 of valve 16 is a continuous skirt which extends around a hollow interior region 24 of the valve that is open at the underside of the valve. The lower portion 23, including the hollow interior region 24, has a greater breadth or diameter than the air passage 21 of lid 14. Thus the hollow interior region 24 of the valve 16 overlaps portions of the outer surface 22 of lid 14 that are adjacent to air passage 21 and extends the vacuum region defined by container 12 outward over a sizable area of the upper surface 22 of lid 14. Consequently/ after evacuation of the container 12, the external atmosphere exerts pressure against a greater area of valve 16 than would be the case if the underside of the valve was exposed to vacuum only at air passage 21. This produces a very strong sealing force and reliably prevents leakage.

Evacuation of the container 12 and interior region 24 of valve 16 results in atmospheric pressure forces that may urge the upper portion 26 of the valve downward towards lid 14 at least in instances where the valve is a unitary body of resilient material. To prevent an irregular buckling of the valve under these circumstances, which might disrupt the desired seal, the upper portion 26 of the valve 16 has a smaller breadth or diameter than the lower portion 23. The upper portion 26 has the shape of an inverted cup, which is preferably of diminishing diameter in the downward direction, and is joined to the upper edge of the lower portion 23 by a horizontally extending transition region 27 of the elastomeric material. Thus any deformation of the valve 16 by external air pressure simply causes flexing of the transition region 27 to enable the upper portion 26 to sink downward while maintaining a coaxial relationship with the lower portion 23 and a symmetrical configuration of the valve as a whole. The resulting abutment of the flexed transition region 27 against the inside of lower portion 23 makes the lower portion more resistant to deformation.

Means 29 are provided for loosely attaching valve member 16 to lid 14 to prevent separation of the components and to prevent inadvertent dislodging of the valve member 16 when the container 12 is evacuated. Such means 29, in this example, includes a stem 31 which extends down from the center of the the upper portion 26 of valve 16 through the hollow interior region 24 and lid passage 21 to a location below the lid 14. The diameter of stem 31 is smaller than the diameter of passage 21 to avoid blockage of air flow through the passage. The lower end of stem 31 carries an enlargement 33 which is broader than passage 24 and which is spaced a small distance downward from the lid 14 when the valve member 16 is resting on the lid. Thus the valve member 16 cannot be pulled away from lid 14 but can lift a small distance, as indicated by dashed lines 16*a* to enable escape of air from container 12 through passage 21.

The stem 31 of this embodiment is integral with other portions of the valve 16 and thus is formed of the same resilient elastomeric material. Thus the enlargement 33 can be forced through air passage 21 as it is compressible. Forcing of the enlargement 33 through passage 21 is facilitated if the enlargement has the shape of an inverted truncated cone and has a lower end that is of smaller diameter than the passage and an upper end that is of slightly greater diameter than the passage. This tapered configuration also advantageously increases the resistance of the stem 31 to withdrawal from the passage 21.

Figure 4:
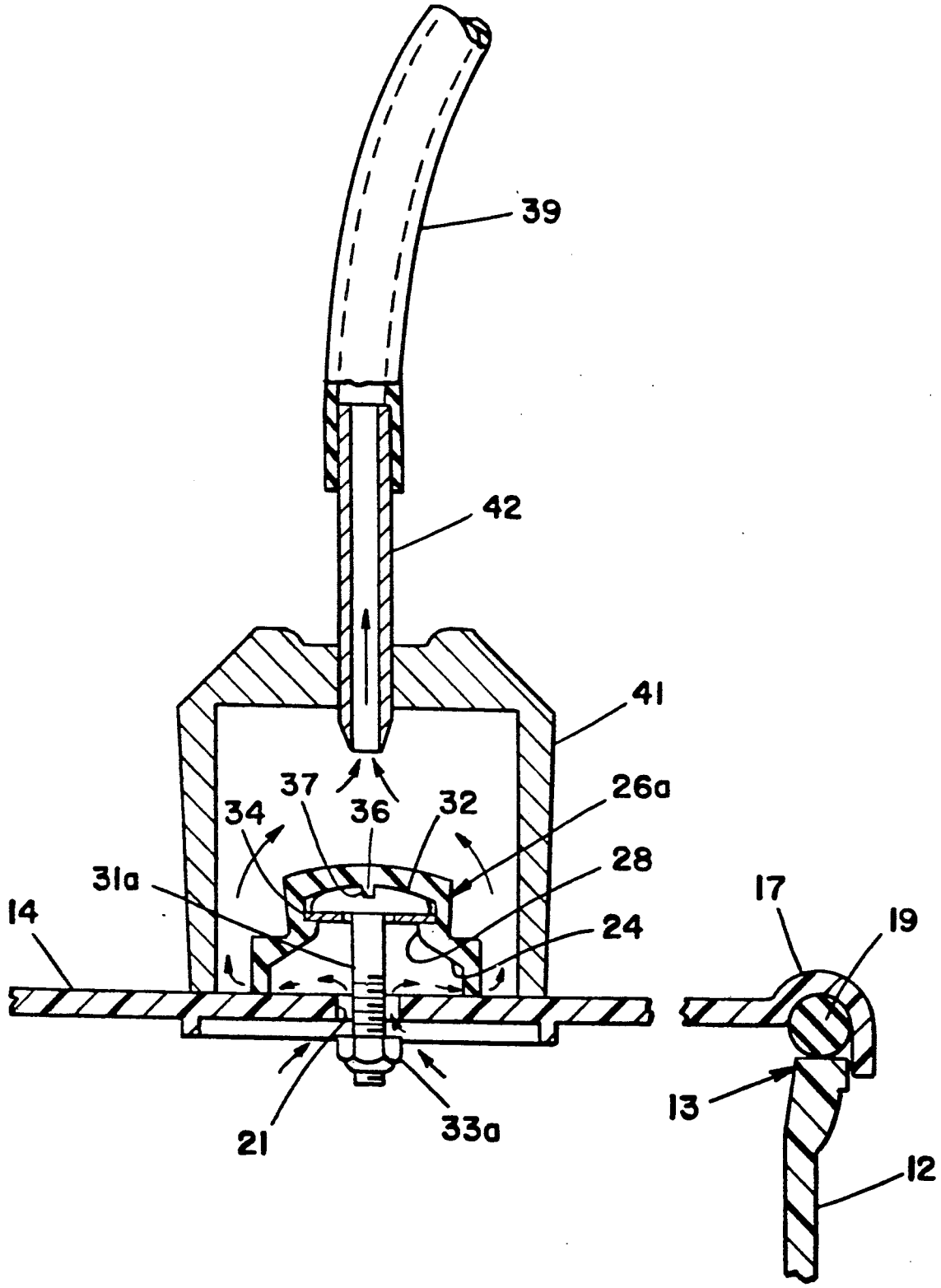
FIG. 4 is an elevation section view of a modified form of the valve component.

The stem 31 need not be an integral resilient portion of the valve 16 body. Referring to FIG. 4, the stem 31*a* can be a threaded screw and the enlargement 33*a* can be a locknut which is engaged on the lower end of the screw after it has been inserted through lid passage 21 The upper portion of the hollow interior region 24 within valve 16 is shaped to conform with the head 32 of the screw and a lip 28 on the inside wall of the valve extends under the peripheral region of the screw head to attach the screw to the body of valve 16. A small flat washer 34 is preferably disposed between the lip 28 and screw head 32. A rib 36 extending down from the top wall of the upper portion 26*a* of the valve 16 is received in the slot 37 of screw head 32 to prevent turning of the screw 31*a* when locknut 33*a* is being engaged.

Figure 5:
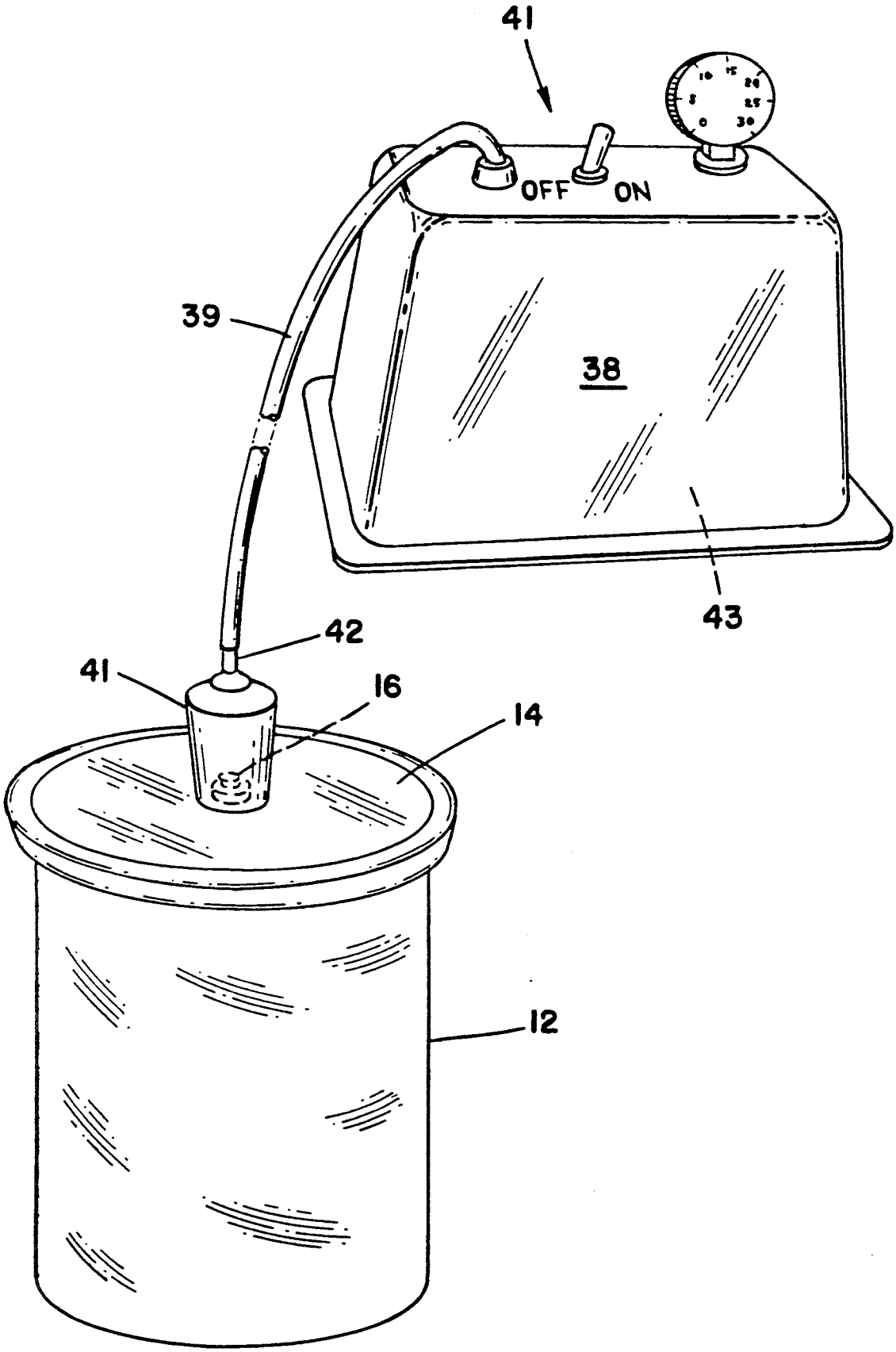
FIG. 5 is another perspective view of the apparatus of the preceding figures depicting use of the system during the stage at which a container is being evacuated.

Referring to FIGS. 2 and 5, air is evacuated from container 12 by a vacuum pump 38 that may be of known construction and which has a vacuum hose 39 into which air is drawn in response to operation of a control switch 41. An inverted hollow cup 41 formed of resilient material such as rubber is secured to the end of hose 39 through a tubular fitting 42 Cup 41 has a hollow interior region 43 which is sufficiently broad to enable the cup to be placed on lid 14 over valve 16 and which is of sufficient height to enable the above described lifting of the valve. Cup 41 is preferably proportioned to locate the interior wall 44 of the cup in an outwardly spaced relationship to valve 16. This facilitates gripping and squeezing of the cup in order to withdraw it at the completion of the evacuation without disturbing the valve 16 in the process.

Cup 41 need not be manually held in contact with lid 14 throughout the evacuation process as external air pressure acts to urge the cup against lid 14. The suction generated by vacuum pump 38 holds the valve 16 in the lifted position 16*a* as long as an outflow of air from container 12 is occurring.

The reduction of pressure within container 12 causes the external air pressure to clamp lid 14 onto container rim 13, compressing seal 19 in the process. Upon removal of cup 41 as described above air pressure also clamps valve 16 against lid 14 thereby completing the sealing of the evacuated container 12. As the hollow interior region 24 within valve 16 is broader than the air exhaust passage 21 itself, air pressure generates a very strong clamping force against the valve and thereby assures that leakage will not occur while the contents of container 12 are being stored. The valve configuration makes it practical to use higher degrees of vacuum than are customary in the art without creating a risk of leakage and to thereby increase food storage life.

The strong clamping force does not cause difficulties when the evacuated container 12 is to be re-opened as the vacuum can be easily broken by squeezing or compressing the valve 16 radially inward with the thumb and forefinger of one hand. This allows air to enter region 24 and thus the container 12 itself, equalizing pressures and enabling easy lifting of the lid 14.

Broadening of the valve 16 results in a still greater sealing force but also requires greater manual effort to break the vacuum. It has been found that a valve 16 having an inside diameter of about five eighths of an inch at the lower end and an outside diameter of about three quarters of an inch provides an optimum balancing of sealing force and ease of breaking of the vacuum although this should not be considered to be limiting as valves with other dimensions are also practical. The cup 41 at the end of vacuum hose 39 may then have an inside diameter of about one inch for similar reasons although, again, this should not be considered to be limiting.

Figure 6:
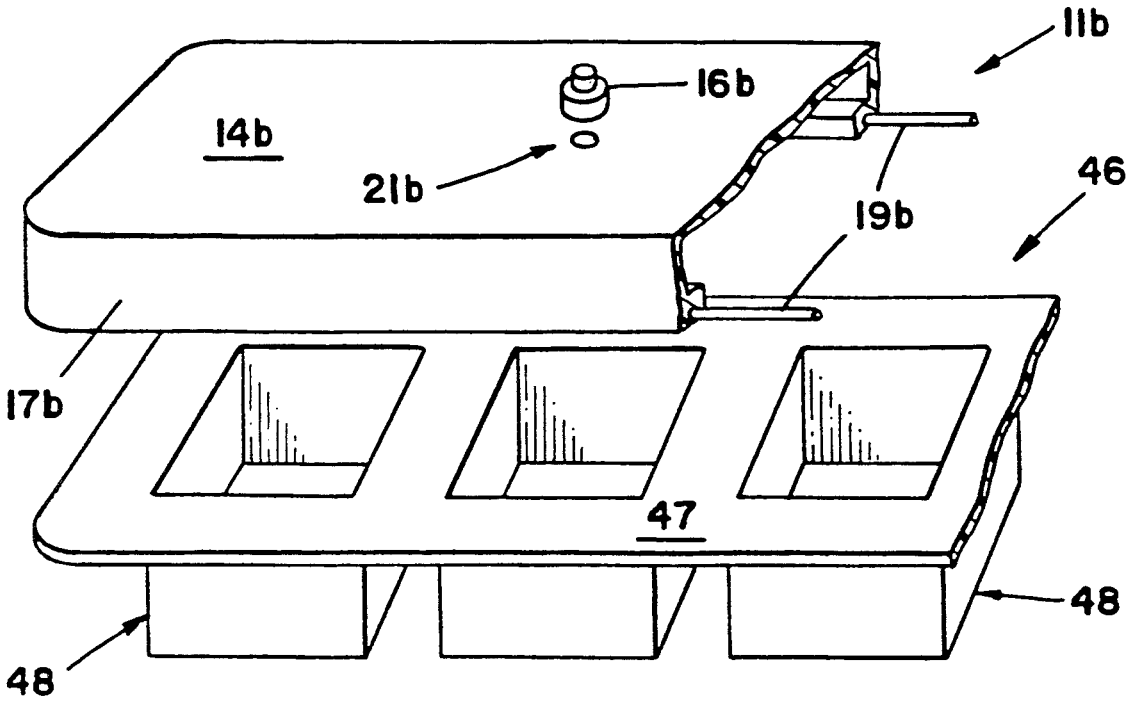
FIG. 6 is a perspective view of another embodiment of the apparatus adapted for simultaneously evacuating and sealing a plurality of containers such as at a restaurant salad bar.

The invention can also be adapted for simultaneous evacuation and sealing of a plurality of containers. Referring to FIG. 6, for example, the salad bars 46 which are commonly found in restaurants typically have a table 47 with a number of recessed receptacles 48 containing different types of food. A system 11*b* for vacuum packing the contents of the salad bar 46 in place during periods when the restaurant is closed may include a lid 14*b* which is sufficiently large and of appropriate shape to cover the entire table 47 or a predetermined portion of the table. The lid 14*b* may have downwardly directed edges 17*b* with a resilient sealing element 19*b* at the bottom for seating against the peripheral region of the table. A valve 16*b* of the previously described type is attached to lid 14*b* in the manner previously described over an air exhaust passage 21*b* in the lid. In large installations, it may be desirable to provide additional passages 21*b* and valves 16*b* for connection to plural vacuum pumps or to plural inlets of a large vacuum pump, in order to speed up the process of evacuating the salad bar.

Figure 7:
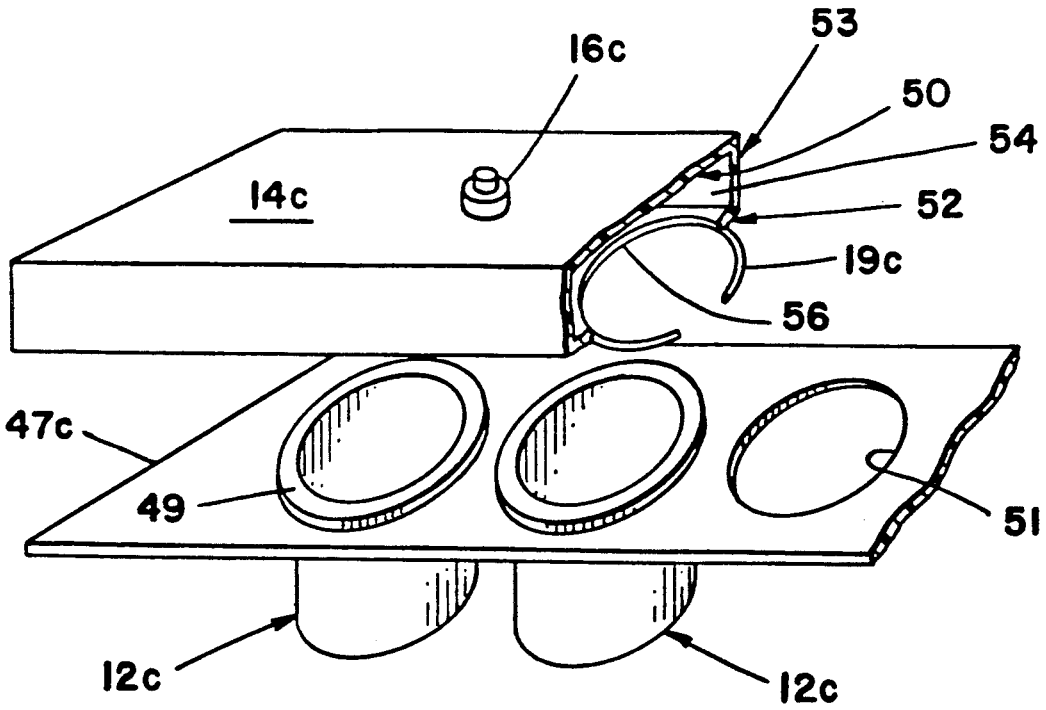
FIG. 7 is a perspective view of still another embodiment of the apparatus which is also adapted for simultaneously evacuating and sealing a plurality of containers.

The arrangement of FIG. 6 is suitable for salad bars 46 or the like in which the food receptacles 48 are built in integral components of the table 47 or are separate containers that rest upon a fluid tight table or the like Referring to FIG. 7, the food receptacles are sometimes separate containers 12*c* which have flanges 49 at the top and which seat in well described above with reference to FIG. 6 can be used with the salad bar of FIG. 7 if seals of any of various known types are situated between the container flanges 49 and underlying regions of the the table 47*c*. Alternately, a manifold like lid 14*c* may be used which has vertically spaced top and bottom panels 50 and 52 respectively and sides 53 which jointly form a chamber 54. Openings 56 in the bottom panel 52 are located to overlay each of the containers 12*c*. Annular O-rings 19*c* are seated in the underside of bottom panel 51 in an encircling relationship with each of the openings 56 and in position to be compressed against the flanges 49 of containers 12c when the interior region of the lid 14c is evacuated. Such evacuation and sealing may be accomplished in the manner hereinbefore described through a valve 16c of the above described type that is located on top panel 51.

While the invention has been described with respect to certain specific preferred embodiments, many modifications and variations are possible and it is not intended to limit the invention except as defined in the following claims.

I claim:

1. In container closure apparatus for enabling evacuation and sealing of a container by a vacuum pump of the type having a cup-like air intake, said closure apparatus being adapted for use with containers of the type having a rigid rim defining a container opening, the combination comprising:

a lid adapted for sealing engagement on said container rim over said container opening, said lid having an outer surface and an air passage which communicates said outer surface with the interior of said container when said lid is engaged thereon, and a hollow valve disposed on said outer surface of said lid over said air passage and being proportioned to fit within said air intake, the lower portion of said valve being a resilient skirt which extends outward from said outer surface of said lid and which extends around a hollow interior chamber within said valve, both said skirt and said hollow chamber being broader than said air passage thereby causing said skirt to contact said outer surface of said lid at locations which are away from the periphery of said air passage and causing said hollow chamber to overlap the regions of said outer surface of said lid that are adjacent to said air passage, said hollow chamber being open at the underside of said valve, said valve further having means for inhibiting removal of said valve from said lid, wherein said lower portion of said valve has a cylindrical configuration and wherein said valve has an inverted cup shaped upper portion that spans said hollow interior chamber and which is of smaller breadth than said lower portion and wherein said valve further has a transition section that interconnects the bottom edge of said upper portion and the top edge of said lower portion, said upper and lower portions being in coaxial relationship and at least said transition section being formed of resilient material whereby said upper portion may be forced downward into a nesting relationship with said lower portion.

2. The apparatus of claim 1 wherein said upper portion of said valve is of diminishing breadth towards the bottom of said upper portion.

3. The apparatus of claim 1 wherein said valve including said upper and lower portions and said transition section is a single integral element formed of resilient material.

4. In container closure apparatus for enabling evacuation and sealing of a container by a vacuum pump of the type having a cup-like air intake, said closure apparatus being adapted for use with containers of the type having a rigid rim defining a container opening, the combination comprising:

a lid adapted for sealing engagement on said container rim over said container opening, said lid having an outer surface and an air passage which communicates said outer surface with the interior of said container when said lid is engaged thereon, and a hollow valve disposed on said outer surface of said lid over said air passage and being proportioned to fit within said air intake, the lower portion of said valve being a resilient skirt which extends outward from said outer surface of said lid and which extends around a hollow interior chamber within said valve, both said skirt and said hollow chamber being broader than said air passage thereby causing said skirt to contact said outer surface of said lid at locations which are away from the periphery of said air passage and causing said hollow chamber to overlap the regions of said outer surface of said lid that are adjacent to said air passage, said hollow chamber being open at the underside of said valve, said valve further having means for inhibiting removal of said valve from said lid, wherein said valve has an upper portion that spans said hollow interior chamber and wherein said means for inhibiting removal of said valve from said lid includes a stem that extends down from said upper portion of said valve through said chamber and through said air passage of said lid and which has a lower end carrying an enlargement that is broader than said passage, wherein said stem is a threaded screw having a screw head with a slot therein and wherein said enlargement is a locknut engaged on said lower end of said screw, said screw head being in the upper region of said hollow interior chamber and wherein said valve has a resilient lip which extends under said screw head to attach said screw to said upper portion of said valve.

5. The apparatus of claim 4 wherein said valve has a rib of material extending into said slot of said screw head.

6. In container closure apparatus for enabling evacuation and sealing of a container by a vacuum pump of the type having a cup-like air intake, said closure apparatus being adapted for use with containers of the type having a rigid rim defining a container opening, the combination comprising:

a lid adapted for sealing engagement on said container rim over said container opening, said lid having an outer surface and an air passage which communicates said outer surface with the interior of said container when said lid is engaged thereon, and wherein said lid is proportioned to span and simultaneously seal a plurality of said containers, and a hollow valve disposed on said outer surface of said lid over said air passage and being proportioned to fit within said air intake, the lower portion of said valve being a resilient skirt which extends outward from said outer surface of said lid and which extends around a hollow interior chamber within said valve, both said skirt and said hollow chamber being broader than said air passage thereby causing said skirt to contact said outer surface of said lid at locations which are away from the periphery of said air passage and causing said hollow chamber to overlap the regions of said outer surface of said lid that are adjacent to said air passage, said hollow chamber being open at the underside of said valve, said valve further having means for inhibiting removal of said valve from said lid.

7. Closure apparatus for enabling evacuation and sealing of a container by means of a vacuum pump having a cup-like air intake, the apparatus being adaptable to sealing of a container of the type which has a rigid rim forming a container opening, wherein said closure apparatus comprises:

a rigid lid adapted for sealing engagement with said container over said container opening, said lid having outer and inner surfaces and having an air passage which extends between said surfaces, a hollow valve disposed on said outer surface of said lid over said air passage and having a stem which extends through said passage and which has an enlargement which inhibits removal of said valve from said lid, the lower portion of said valve being a cylindrical resilient skirt having an inner surface that is of greater diameter than said air passage and which is spaced apart from said air passage to define a chamber within said valve that is of greater breadth than said air passage and which overlaps the portions of said outer surface of said lid that encircle said air passage, said valve further having an upper portion which is of smaller diameter than said cylindrical resilient skirt and a flexible transition section which interconnects said upper portion and said cylindrical resilient skirt and which enables said upper portion to be forced downward by air pressure into a nesting relationship with said cylindrical resilient skirt.

* * * * *